US006988751B2

(12) United States Patent
Fishencord

(10) Patent No.: US 6,988,751 B2
(45) Date of Patent: Jan. 24, 2006

(54) NON-ROTATIONAL LOCK CHASSIS ASSEMBLY

(75) Inventor: Eric E. Fishencord, Colorado Springs, CO (US)

(73) Assignee: Schlage Lock Company, Indianapolis, IN (US)

( * ) Notice: Subject to any disclaimer, the term of this patent is extended or adjusted under 35 U.S.C. 154(b) by 108 days.

(21) Appl. No.: 10/379,841

(22) Filed: Mar. 5, 2003

(65) Prior Publication Data

US 2004/0174023 A1 Sep. 9, 2004

(51) Int. Cl.
*E05B 3/00* (2006.01)

(52) U.S. Cl. ..... 292/336.3; 292/357; 292/DIG. 53

(58) Field of Classification Search ..... 292/336.3, 292/357, DIG. 53, DIG. 60, DIG. 64
See application file for complete search history.

(56) References Cited

U.S. PATENT DOCUMENTS 2,764,445 A * 9/1956 Cerf ..... 292/337
3,985,008 A * 10/1976 Hart ..... 70/224
5,265,924 A * 11/1993 Kim ..... 292/336.3
5,481,890 A * 1/1996 Millman ..... 70/224
5,590,555 A * 1/1997 Kester et al. ..... 70/224
5,732,578 A * 3/1998 Kang ..... 70/224
6,279,360 B1 * 8/2001 Shen ..... 70/224
6,302,457 B1 * 10/2001 Shen ..... 292/357
6,619,710 B1 * 9/2003 Hwang ..... 292/336.3

* cited by examiner

*Primary Examiner*—Gary Estremsky
(74) *Attorney, Agent, or Firm*—Michael Best & Friedrich LLP

(57) ABSTRACT

The invention is an anti-rotational lock chassis for a retractable latch. The lock chassis includes a first hub having at least one flat side and a second hub with a thread exterior. An internally threaded plate receives the externally threaded hub. The flat-sided plate receives the flat-sided hub. Each plate is positioned between a spring cage assembly and the chassis. The spring cage assembly includes a drive spindle that rotates to extend and retract the latch to secure access through a door. A connecting element interconnects the spring case assemblies. Cutouts in each plate engage the connecting elements, thereby constraining the plates and chassis from rotating inside the door.

20 Claims, 4 Drawing Sheets

NON-ROTATIONAL LOCK CHASSIS ASSEMBLY

FIELD OF THE INVENTION

The present invention relates to a lock assembly. In particular, this invention relates to a non-rotational lock chassis assembly for a door.

BACKGROUND OF INVENTION

Certain door lock assemblies generally include a latch assembly supported by a lock chassis. The latch assembly extends and retracts a latch in securing access through the door. The lock chassis supports the operation of the latch assembly inside the door.

SUMMARY OF THE INVENTION

A problem in the industry with lock assemblies is their susceptibility to rotation inside the door, interrupting the operation of the latch assembly. The non-rotational lock chassis assembly of the invention constrains rotation of the chassis as well as allows adjustment for centering the chassis in doors having varying thicknesses.

One embodiment of the invention is a non-rotational lock chassis assembly for a door that includes a chassis having a first hub and a second hub, a first plate having a first opening with at least one flat side for receiving the first hub of the lock chassis, a second plate having a second opening with a threaded interior for receiving the second hub of the chassis, at least one connecting element that interconnects the first plate and the second plate, wherein the first plate and the second plate engage the at least one connecting element to constrain rotation of the chassis inside the door.

A second embodiment of the invention is a lock assembly for a door that includes a latch assembly having a latch that extends and retracts to secure the door, a chassis in support of the latch assembly, the chassis having an integral first hub and second hub, a first spring cage having a first spindle that rotates to extend and retract the latch assembly, a second spring cage having a second spindle that rotates to extend and retract the latch, a first plate having a first opening with at least one flat side that receives the first hub, the first plate positioned between the first spring cage and first hub, a second plate having a second opening with a threaded interior that receives the second hub, the second plate positioned between the second spring cage and second hub, at least one connecting element that interconnects the first and second spring cages, and wherein the at least one connecting element engages the first and second plates to constrain rotation of the chassis.

As is apparent from the above, it is an aspect of the invention to provide a non-rotational chassis assembly for a lock assembly of a door. Other features and aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Figure 1:
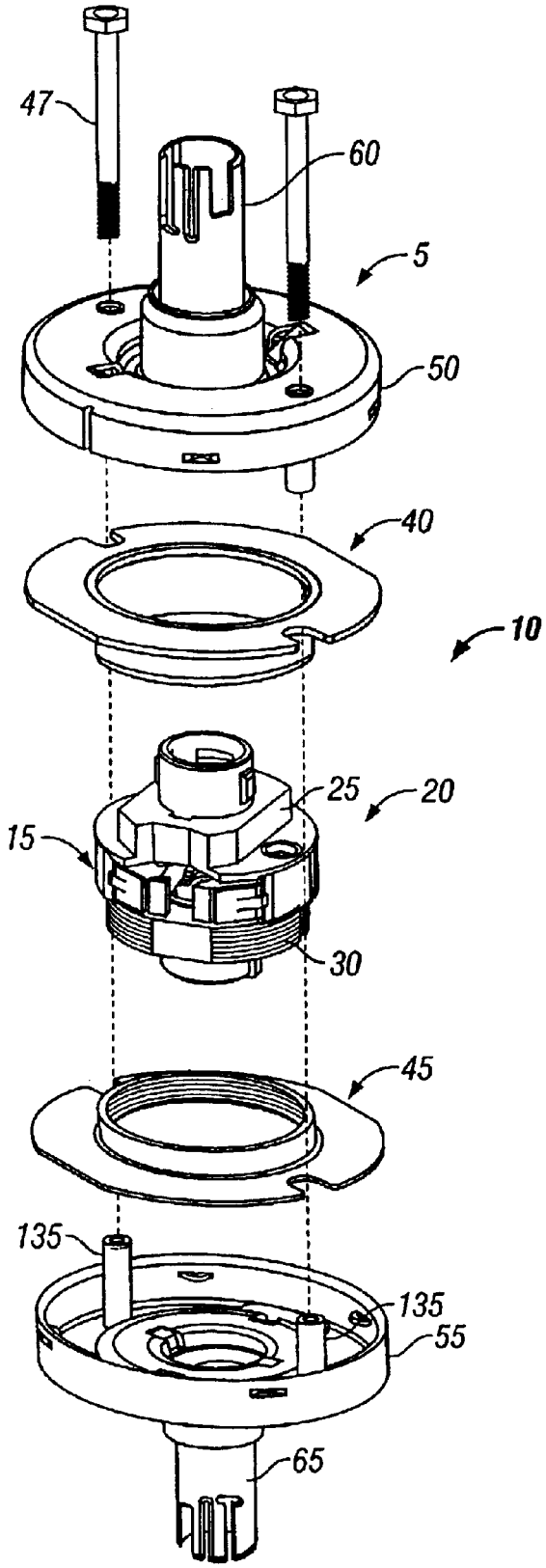
FIG. 1 is a perspective view of an exemplary lock assembly embodying the invention.

FIG. 1 illustrates an exemplary embodiment of the lock assembly 5 of the invention. The lock assembly 5 includes a non-rotational chassis assembly 10 in support of a latch assembly 15. The non-rotational chassis assembly 10 of the invention includes a chassis 20 having a first 25 and a second hub 30, a non-rotational plate 40 that receives the first hub 25 and a threaded plate 45 that receives the second hub 30. At least one connecting element 47 interconnects the non-rotational plate 40 and the threaded plate 45 in constraining the chassis 20 from rotating inside the door. Spring cages 50 and 55 include drive spindles 60 and 65, respectively, that rotate to linearly extend and retract the latch assembly 15 between a locked and an unlocked position, respectively.

Figure 2:
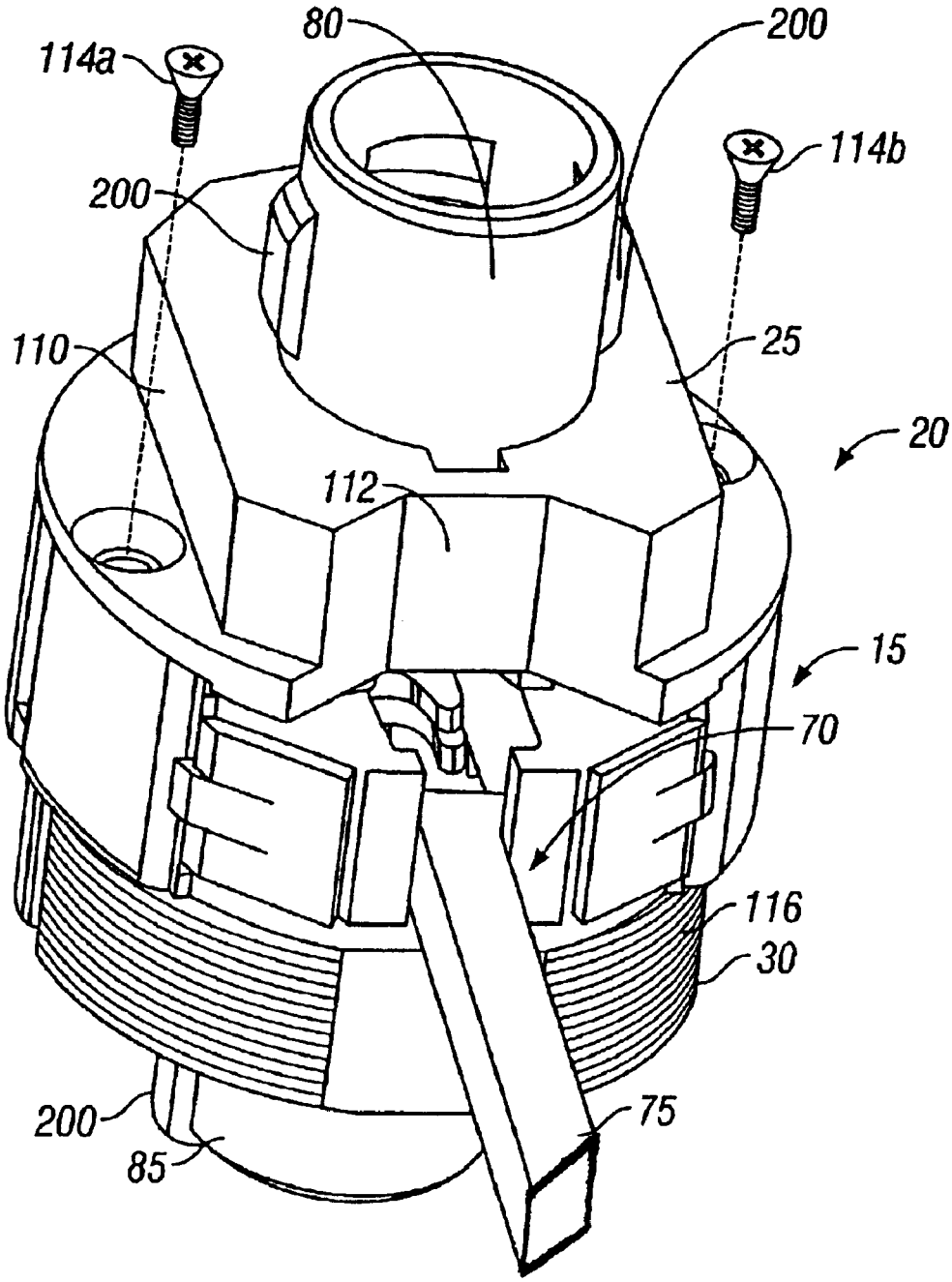
FIG. 2 is a perspective view of a chassis and latch assembly embodying the invention.

FIG. 2 shows a perspective view of an exemplary latch assembly 15 supported by the chassis 20. The latch assembly 15 includes a retractor assembly 70 that extends and retracts a beveled latch or bolt 75 from a locked position to an unlocked position, respectively. Drive shafts 80 and 85 extend from each side of the retractor assembly 70 and pass through openings in the lock chassis assembly 10. Each drive shaft 80 and 85 rotates to move the retractor assembly 70 in a linear direction, thereby retracting and extending the beveled latch 75 to secure access through a door.

The chassis 20 includes the first 25 hub and the second hub 30. The drive shafts 80 and 85 extend through the first 25 and second 30 hubs, respectively, to engage the drive spindles 60 and 65 of the spring cages 50 and 55, respectively. One embodiment of the first hub 25 includes at least one flat side 110. As shown in FIGS. 1 and 2, the exemplary first hub 25 is substantially octagonal-shaped. Of course, the first hub 25 can include other suitable shapes (e.g., square, elliptical, etc.). Another embodiment of the first hub 25 includes a key 112 for aligning the non-rotational plate 40 with the hub 25.

One embodiment of the second hub 30 includes a threaded exterior 116 for receiving the threaded plate 45. In yet another embodiment of the invention, the second hub 30 can include at least one flat side as described above, and the first hub 25 can include the threaded exterior 116. In an alternative embodiment of the invention, both the first 25 and second 30 hubs can include at least one flat side as described above for the first hub 25. However, not providing at least one threaded plate and hub reduces the ability to adjust lock assembly 5 for the thickness of the door.

The exemplary first hub 25 is mounted to the chassis 20 using mounting screws 114. As shown in FIG. 2, two mounting screws 114*a* and 114*b* secure the hub 25 to the chassis 20. Of course, other suitable connection means (e.g., spot-weld, cast, etc.) known to those in the art can be used. The exemplary embodiment of the first 25 and second 30 hubs of the chassis 20 is comprised of a zinc composition. Of course, the hubs 25 and 30 can be comprised of other suitable materials and compositions (e.g., iron, steel, plastic, etc.) known to those in the art.

Figure 3:
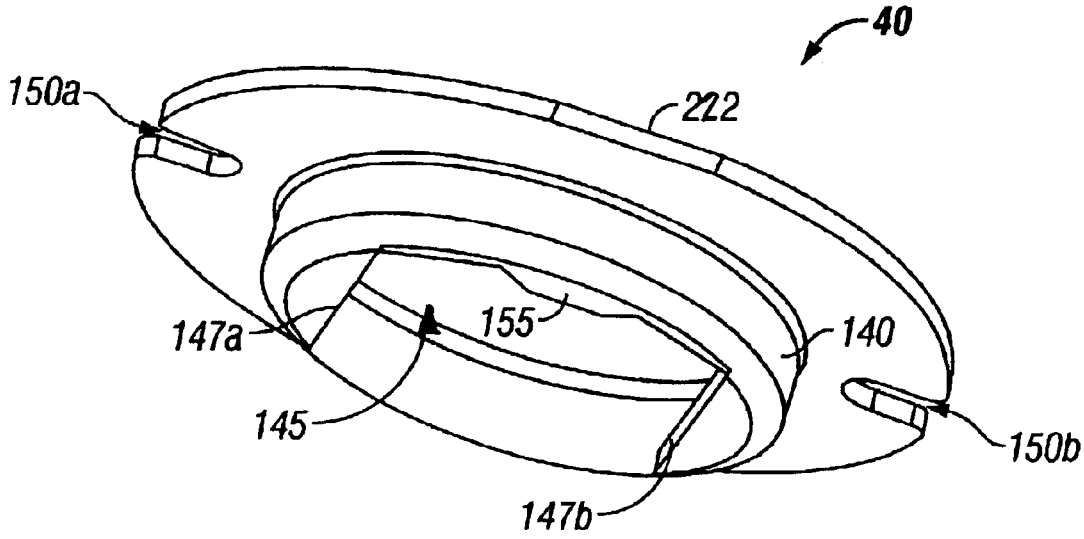
FIG. 3 is a perspective view of a non-rotating plate embodying the invention.

FIG. 3 shows a perspective view of an exemplary non-rotational plate 40 of the invention. The non-rotational plate 40 includes an extension or boss 140 having an opening 145 for receiving the first hub 25 of the chassis. The extension 140 is of length such that the plate 40 lies substantially flush with the top surface of the hub 25. The opening 145 is shaped for receiving the hub 25 of the chassis 20. In one embodiment, the opening 145 includes at least one flat side 147 for engaging the at least one flat side 110 of the chassis 20. In FIG. 3, the exemplary embodiment of the non-rotational plate 40 a flat sides 147*a* and 147*b* that are compatible for receiving the exemplary hub 25 of the chassis 20 described above. Of course, the opening 145 can take other shapes compatible to receive the hub 25. The non-rotational plate 40 further includes at least one cutout or slot 150 located along the plate's perimeter. FIG. 3 shows an exemplary non-rotational plate 40 having a first 150*a* and second slot 150*b*. The at least one slot 150 engages connector elements 47 extending from the non-rotational plate 40 to the threaded plate 45. The engagement of the slots 150*a* and 150*b* with the connecting elements 47 constrains the chassis 20 from rotating in the door. In another embodiment, the plate 40 can include at least one hole in a position to receive the connector element 47 described above. In another embodiment, the non-rotational plate 40 includes an alignment notch or extension 155 that engages the key 112 in the hub 25.

Figure 4:
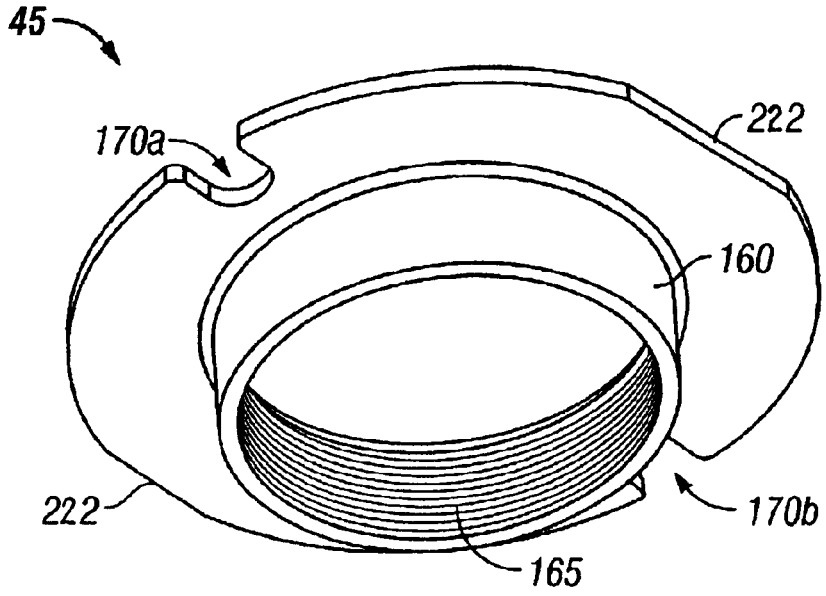
FIG. 4 is a perspective view of a threaded plate embodying the invention.
Figure 5:
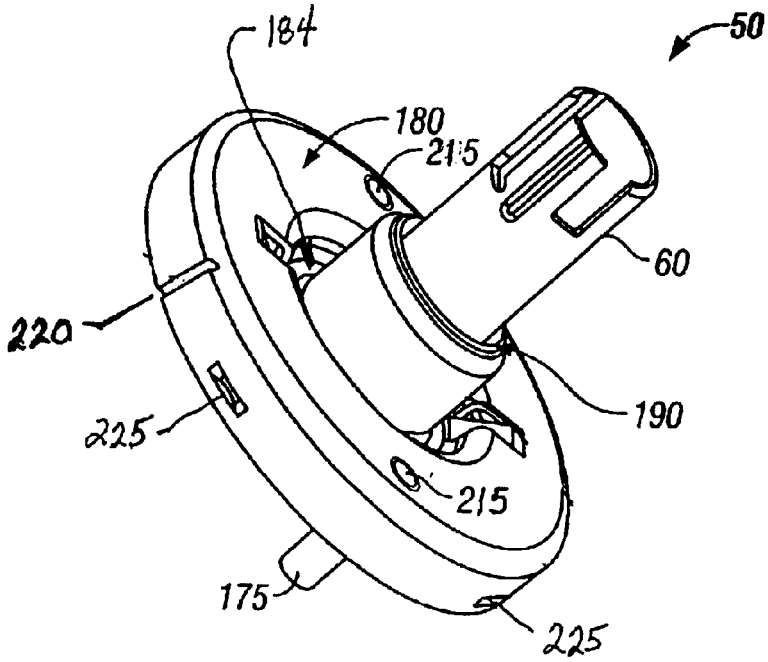
FIG. 5 is a perspective view of an inside spring cage.

FIG. 4 shows an exemplary threaded plate 45 of the invention. The threaded plate 45 includes an extension or boss 160 having a threaded interior 165. The threaded interior 165 is designed to accept or receive the threaded exterior 116 of the second hub 30 of the chassis 20 described above. The depth of the boss 160 is designed to match the depth of the threaded hub 30. One embodiment of the threaded plate 45 further includes at least one notch or slot 170 located along the plate's perimeter similar to the non-rotational plate 40 described above. FIG. 5 shows the threaded plate 45 having a first 170*a* and second 170*b* slot. The slot 170 is designed to receive and engage the connecting element 47 in constraining the chassis 20 from rotating with actuation of the latch assembly 15. The slots 170 are positioned along the threaded plate 45 to align with the slots 150 of the non-rotational plate 40. The slots 150*a* and 150*b* of the non-rotational plate 40 and slots 170*a* and 170*b* of the threaded plate 45 engage the connector elements 47 in substantially the same manner. Of course, holes or extensions at the non-rotational plate 40 or threaded plate 45 can be used to engage the connecting elements 47.

As noted above the non-rotational plate 40 and threaded plate 65 are interchangeable to match the exterior of the first 25 and second 30 hubs of the chassis 20. One embodiment of the non-rotational plate 40 and threaded plate 65 are comprised of steel. Alternatively, the non-rotational plate 40 and threaded plate 65 can be comprised of other suitable materials (e.g., forged metal, plastic) known to those in the art.

As described above, the connecting elements 47 engage the non-rotational plate 40 and threaded plate 45 in constraining rotation of the chassis 20. In one embodiment, the connecting elements 47 are threaded bolts. Of course, other suitable connecting elements (e.g., rods, etc.) known to those in the art can be used.

Figure 6:
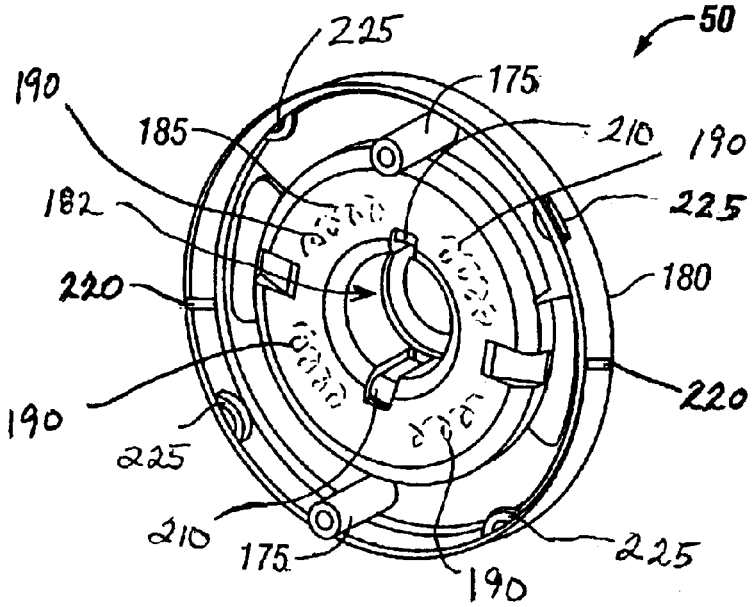
FIG. 6 is a perspective view underneath an inside spring cage.

As shown in FIGS. 5 and 6, the connecting elements 47 can include interior threaded posts 175 attached at the spring cages 50 and 55. The exemplary posts 175 include a threaded interior for receiving a connecting element 47 having a threaded exterior. The posts 175 can attach at either one or both ends of the connecting elements 47. In another embodiment, slots 150 or 170 of the plates 40 and 45 engage the posts 175 interconnected by the connecting elements 47. Of course, the post 175 can vary in length and be located at one or both spring cages 50 and 55. Any suitable means of connecting the posts 175 to the inside spring cages 50 and 55 can be used. Additionally, other suitable connecting elements 47 (e.g., bolts, nuts, etc.) can be used.

FIGS. 5 and 6 illustrate one embodiment of spring cage 50. Many of the elements of the embodiment of spring cage 50 illustrated in FIGS. 5 and 6 are the same or similar to those used in the embodiment of the spring cage 55 illustrated in FIG. 1 and operate in the same or similar manner. Accordingly, the description of the various elements of spring cage 50 illustrated in FIGS. 5 and 6 can be found in spring cage 55.

As shown in FIGS. 5 and 6, the spring cage 50 includes the drive spindle 60 extending through a housing or cover 180. One end of the drive spindle 60 connects to a door lever (not shown). The drive shaft 80, 85 passes through an opening 182 surrounded by a boss 184 in the cover 180. A retainer ring 190 is positioned around the spindle 60 at the opening 182 to secure the drive spindle 60 to the cover 180.

The other end of the drive spindle 60 is integral with a torque plate 185 that biases underneath the cover 180. One embodiment of the torque plate 185 includes a hallowed radial area for positioning at least one spring or spring component 190 (shown hidden by dashed lines). The hollowed area of the torque plate 185 creates a raceway with the boss 184 of the cover 180 for the positioning the at least one spring or spring components 190. Tabs located radially along the boss 184 of the cover 180 and tabs located radially on the torque plate 185 compress the springs 190. The springs 190 bias rotation of the drive spindle 60 back to its original position.

As shown in FIGS. 5 and 6, the exemplary embodiment of the torque plate 185 further includes at least one drive slot 210 that engages extensions 200 at the drive shafts 80 and 85. Engagement of the drive slot 210 and torque plate 185 with the extensions 200 on the drive shaft 80 enables rotation by a door lever to extend and retract the latch assembly 15.

The exemplary embodiment of the cover 180 further includes at least one connector opening or slot 215 for receiving the at least one connecting element 47. In one embodiment, the connecting elements 47 extend through the openings 215 to interconnect the spring cages 50 and 55 with the non-rotational plate 40, threaded plate 45, and chassis 20. The non-rotational plate 40 and threaded plate 65 further include a pair of flat portions 222 located along the perimeter. The flat portions 222 provide a space to accommodate the rose indents 220.

As shown in FIGS. 5 and 6, another embodiment of the cover 180 includes a plurality of plate supports 225 positioned in the interior along the rim of the cover 180. The plate supports 225 support the non-rotational plate 40 and threaded plate 45 positioned underneath the cover 180.

Thus, the invention provides, among other things, a non-rotational lock chassis assembly. Various features and advantages of the invention are set forth in the following claims.

What is claimed is:

1. A non-rotational chassis assembly, comprising:

a chassis having a first hub and a second hub;

a first plate having a first opening with at least one flat side for receiving the first hub of the lock chassis;

a second plate having a second opening with a threaded interior for receiving the second hub of the chassis, the opening of the second plate being centrally located in a boss; and at least one connecting element that interconnects the first plate and the second plate;

wherein the first plate and the second plate engage the at least one connecting element to constrain rotation of the chassis.

2. The non-rotational assembly of claim 1, wherein the opening of the first plate is centrally located in a boss.

3. The non-rotational assembly of claim 1, wherein the first plate further includes at least one slot that engages the at least one connecting element.

4. The non-rotational assembly of claim 3, wherein at least one post is connected to the at least one connecting element, and wherein the slot of the first plate engages the at least one post.

5. The non-rotational assembly of claim 1, wherein the second plate further includes at least one slot that engages the at least one connecting element.

6. The non-rotational assembly of claim 5, wherein at least one post is connected to the at least one connecting element, and wherein the slot of the second plate engages the at least one post.

7. The non-rotational assembly of claim 1, wherein the first opening of the first plate includes eight sides for receiving the first hub having at least eight sides.

8. The non-rotational assembly of claim 1, wherein the first hub includes an alignment notch for receiving a key in the opening of the first plate.

9. A lock assembly for a door, the lock assembly comprising:

a latch assembly having a latch that extends and retracts to secure the door;

a chassis in support of the latch assembly, the chassis having a first hub with at least one flat side and a second hub with a threaded exterior;

a first spring cage having a first spindle that rotates to extend and retract the latch;

a second spring cage having a second spindle that rotates to extend and retract the latch;

a first plate having a first opening with at least one flat side for receiving the first hub of the chassis, the first plate positioned between the first spring cage and first hub;

a second plate having a second opening with a threaded interior for receiving the second hub of the chassis, the second plate positioned between the second spring cage and second hub;

at least one connecting element that interconnects the first and second spring cages; and wherein the at least one connecting element engages the first and second plates to constrain rotation of the chassis and the first spring cage and the second spring cage each include at least one connector opening for receiving the at least one connecting element.

10. The lock assembly of claim 9, wherein the first opening of the first plate is centrally located in a first boss.

11. The lock assembly of claim 9, wherein the second opening of the second plate is centrally located in a second boss.

12. The lock assembly of claim 9, wherein the first plate further includes at least one slot that engages the at least one connecting element.

13. The lock assembly of claim 12, wherein the first spring cage includes at least one post connected to the at least one connector opening for receiving the at least one connecting element, and wherein the at least one slot of the first plate engages the at least one post.

14. The lock assembly of claim 9, wherein the second plate further includes at least one slot that engages the at least one connecting element.

15. The lock assembly of claim 14, wherein the second spring cage includes at least one post connected to the at least one connector opening for receiving the at least one connecting element, and wherein the at least one slot of the second plate engages the at least one post.

16. The lock assembly of claim 9, wherein the first opening of the first plate includes two flat sides for receiving the first hub.

17. The lock assembly of claim 9, wherein the first hub includes an alignment notch for receiving a key in the opening of the first plate.

18. A non-rotational chassis assembly, comprising:

a chassis having a first hub and a second hub;

a first plate having a first opening with at least one flat side for receiving the first hub of the lock chassis, the opening of the first plate being centrally located in a boss;

a second plate having a second opening with a threaded interior for receiving the second hub of the chassis; and at least one connecting element that interconnects the first plate and the second plate;

wherein the first plate and the second plate engage the at least one connecting element to constrain rotation of the chassis.

19. A non-rotational chassis assembly, comprising:

a chassis having a first hub and a second hub;

a first plate having a first opening with at least one flat side for receiving the first hub of the lock chassis;

a second plate having a second opening with a threaded interior for receiving the second hub of the chassis; and at least one connecting element that interconnects the first plate and the second plate;

wherein the first plate and the second plate engage the at least one connecting element to constrain rotation of the chassis and the first plate further includes at least one slot that engages the at least one connecting element.

20. A non-rotational chassis assembly, comprising:

a chassis having a first hub and a second hub;

a first plate having a first opening with at least one flat side for receiving the first hub of the lock chassis;

a second plate having a second opening with a threaded interior for receiving the second hub of the chassis; and at least one connecting element that interconnects the first plate and the second plate;

wherein the first plate and the second plate engage the at least one connecting element to constrain rotation of the chassis and the second plate further includes at least one slot that engages the at least one connecting element.

* * * * *